US012467401B2

(12) United States Patent
Li et al.

(10) Patent No.: US 12,467,401 B2
(45) Date of Patent: Nov. 11, 2025

(54) EXPANSION TANK, COOLING SYSTEM, AND VEHICLE

(71) Applicants: Zhejiang Geely Holding Group Co., LTD., Zhejiang (CN); Ningbo Geely Automobile Research and Development Co., Ltd, Zhejiang (CN)

(72) Inventors: Guibin Li, Zhejiang (CN); Bingrong Lin, Zhejiang (CN); Junbo Xu, Zhejiang (CN)

(73) Assignees: ZHEJIANG GEELY HOLDING GROUP CO., LTD., Zhejiang (CN); NINGBO GEELY AUTOMOBILE RESEARCH AND DEVELOPMENT CO., LTD., Zhejiang (CN)

( * ) Notice: Subject to any disclaimer, the term of this patent is extended or adjusted under 35 U.S.C. 154(b) by 201 days.

(21) Appl. No.: 18/223,821

(22) Filed: Jul. 19, 2023

(65) Prior Publication Data

US 2023/0366341 A1 Nov. 16, 2023

Related U.S. Application Data

(63) Continuation of application No. PCT/CN2022/086407, filed on Apr. 12, 2022.

(30) Foreign Application Priority Data

Jun. 18, 2021 (CN) ..... 202110677593.5

(51) Int. Cl.
*F01P 11/02* (2006.01)
*F01P 3/18* (2006.01)
*F01P 5/10* (2006.01)

(52) U.S. Cl.
CPC ..... *F01P 11/029* (2013.01); *F01P 3/18* (2013.01); *F01P 5/10* (2013.01)

(58) Field of Classification Search
CPC .... F24D 3/1008; F24D 3/1041; F15B 21/044; F01P 11/029; F01P 5/10
See application file for complete search history.

(56) References Cited

U.S. PATENT DOCUMENTS

2010/0006577 A1* 1/2010 Koshino ..... F01P 11/029 220/501
2010/0206882 A1* 8/2010 Wessels ..... F01P 11/029 220/562

(Continued)

FOREIGN PATENT DOCUMENTS

CN 104265436 A 1/2015
CN 204783236 U 11/2015

(Continued)

OTHER PUBLICATIONS

Li et al. (CN206530395U) English Translation (Year: 2017).*

(Continued)

*Primary Examiner* — Elizabeth J Martin
*Assistant Examiner* — Keona Lauren Banks
(74) *Attorney, Agent, or Firm* — Davis Wright Tremaine LLP

(57) ABSTRACT

An expansion tank, including a tank body, in which a first chamber, a second chamber, and a first through hole through which the first chamber communicates with the second chamber are provided; the tank body has a pipe communicating with an interior of the tank body, and a side wall of the pipe has a mixed liquid inlet; a second partition is provided within the pipe; one end of the second partition is connected to the side wall and the other end of the second partition extends to the mixed liquid inlet to form a first channel and a second channel; a first end of the first channel is connected to the first chamber, a second end of the first channel is closed, a first end of the second channel is (Continued)

connected to the second chamber, and a second end of the second channel is connected to a water pump.

12 Claims, 5 Drawing Sheets

(56) References Cited

U.S. PATENT DOCUMENTS

| | | | | |
|---|---|---|---|---|
| 2018/0283261 | A1 | 10/2018 | Morishita et al. | |
| 2020/0149464 | A1 | 5/2020 | Trythall et al. | |
| 2022/0106903 | A1 * | 4/2022 | Allan | B60K 11/02 |

FOREIGN PATENT DOCUMENTS

| | | | | |
|---|---|---|---|---|
| CN | 206530395 | U | * | 9/2017 |
| CN | 209369912 | U | * | 9/2019 |
| CN | 209855897 | U | * | 12/2019 |
| CN | 210941251 | U | | 7/2020 |
| CN | 211573631 | U | | 9/2020 |
| CN | 113250806 | A | | 8/2021 |
| DE | 29621353 | U1 | * | 2/1997 |
| DE | 102006014400 | A1 | | 8/2007 |
| DE | 102006032792 | A1 | | 1/2008 |
| FR | 2511489 | A1 | | 2/1983 |
| GB | 2360838 | A | | 10/2001 |
| JP | H05209522 | A | | 8/1993 |
| JP | 2014070490 | A | | 4/2014 |
| JP | 2014118884 | A | | 6/2014 |
| JP | 2017166347 | A | | 9/2017 |
| JP | 2018053885 | A | | 4/2018 |

OTHER PUBLICATIONS

Chen et al (CN209855897U) English Translation (Year: 2019).*
Zhang (CN209369912U) English Translation (Year: 2019).*
Reflex Winkelmann & Pannhoff G (DE29621353U1) English Translation (Year: 1997).*
Japan Patent Office, "Decision to Grant a Patent" in Application No. 2023-543419, May 27, 2024, 5 pages.
European Patent Office, "Extended European Search Report" in Application No. 22823884.6-1004, Jul. 12, 2024, 6 pages.
Notification to Grant Patent Right for Invention issued in related Chinese Application N. 202110677593.5, on Feb. 7, 2022, in 6 pages.
International Search Report issued in related International Application No. PCT/CN2022/086407, mailed on Jun. 27, 2022, in 12 pages.

* cited by examiner

EXPANSION TANK, COOLING SYSTEM, AND VEHICLE

CROSS-REFERENCE TO RELATED APPLICATIONS

This application continuation of International Application No. PCT/CN2022/086407, filed on Apr. 12, 2022, which claims priority to Chinese Patent Application No. 202110677593.5, filed on Jun. 18, 2021. The disclosures of the aforementioned applications are hereby incorporated by reference in their entireties.

TECHNICAL FIELD

The present application relates to the vehicle parts manufacturing technology and, in particular, to an expansion tank, a cooling system, and a vehicle.

BACKGROUND

A main job of a cooling system of a vehicle is to dissipate heat into the air to prevent parts from overheating, where an expansion tank is an important part in the cooling system of the vehicle. The expansion tank can store a cooling liquid and supplement the cooling liquid to the cooling system in time when the cooling system lacks the cooling liquid.

In the solution of the related art, a cooling system that is provided on an electric vehicle includes an expansion tank, a liquid-air separator, an electronic water pump, a part to be cooled (such as a battery pack, a motor, etc.) and a heat exchanger. The liquid-air separator, the electronic water pump, the part to be cooled and the heat exchanger are connected in turn by pipelines to form a closed-loop circuit. The expansion tank is connected to the liquid-air separator by a pipeline, thereby absorbing the air separated from the liquid-air separator or supplementing a cooling liquid to the liquid-air separator. When in use, the electronic water pump is started to drive the cooling liquid and a gas to flow into the part to be cooled and take heat away, then the cooling liquid enters the heat exchanger for cooling; and the cooling liquid flowing out from the heat exchanger enters the liquid-gas separator for gas-liquid separating, where the gas flows into the expansion tank and the separated cooling liquid flows into the electronic water pump for continuing to perform cooling cycle.

However, when the solution of the related art is used, the number of parts in the cooling system is high and the weight of the parts is heavy, therefore, it is not conducive to lightweight of vehicles.

SUMMARY

In order to overcome the aforesaid defects in the related art, the present application aims to provide an expansion tank, a cooling system, and a vehicle to decrease the number and weight of parts in the cooling system, thereby facilitating the lightweight of the vehicle.

An embodiment of the present application provides an expansion tank including a tank body, a first partition is provided within the tank body, the first partition divides an interior of the tank body into a first chamber and a second chamber, and the first partition is provided with a first through hole, and the first chamber communicates with the second chamber through the first through hole:

the tank body is provided with a pipe communicating with an interior of the tank body, and a side wall of the pipe is provided with a mixed liquid inlet; a second partition is provided within the pipe, one end of the second partition is connected to the side wall of the pipe and the other end of the second partition extends to the mixed liquid inlet so as to form a first channel and a second channel within the pipe; the mixed liquid inlet is simultaneously connected to a side wall of the first channel and a side wall of the second channel; in a direction perpendicular to an axis of the mixed liquid inlet, a first end of the first channel is connected to the first chamber, a second end of the first channel is closed, a first end of the second channel is connected to the second chamber, a second end of the second channel is configured to be connected to connect a water pump.

The expansion tank as described above, in an implementation, an area of the mixed liquid inlet communicating with the first channel is smaller than an area of the mixed liquid inlet communicating with the second channel.

The expansion tank as described above, in an implementation, an end cap is provided on the second end of the first channel, and the end cap is fixedly connected to the pipe and the second partition.

The expansion tank as described above, in an implementation, the pipe is cylindrical or prismatic in shape, an axis of the pipe is perpendicular to an axis of the mixed liquid inlet.

The expansion tank as described above, in an implementation, the tank body includes a first sub-tank body and a second sub-tank body, the first sub-tank body and the second sub-tank body are welded to form the tank body.

The expansion tank as described above, in an implementation, the first chamber includes a plurality of first sub-chambers, a third partition is provided between two adjacent first sub-chambers, the third partition is provided with a third through hole: the second chamber includes a plurality of second sub-chambers, a fourth partition is provided between two adjacent second sub-chambers, the fourth partition is provided with a fourth through hole.

The expansion tank as described above, in an implementation, the first through hole is provided between the first sub-chambers and the second sub-chambers adjacent to the first sub-chambers: or the first through hole is provided between one first sub-chamber of the first sub-chambers and one second sub-chamber of the second sub-chambers adjacent to the one first sub-chamber.

The expansion tank as described above, in an implementation, a plurality of reinforcing ribs are further provided within the tank body.

Another embodiment of the present application provides a cooling system including a water pump, a part to be cooled, a heat exchanger, and the expansion tank as any one of described above: the water pump, the part to be cooled, the heat exchanger, and the expansion tank are connected in turn by pipelines, where the heat exchanger is connected to the mixed liquid inlet of the expansion tank, the second channel of the expansion tank is connected to the water pump.

A further embodiment of the present application provides a vehicle including the cooling system as described above.

The present application provides an expansion tank, a cooling system, and a vehicle, the expansion tank includes a tank body, a first partition is provided within the tank body, the first partition divides an interior of the tank body into a first chamber and a second chamber, the first partition is provided with a first through hole, and the first chamber communicates with the second chamber through the first through hole: the tank body is provided with a pipe communicating with an interior of the tank body, and a side wall of the pipe is provided with a mixed liquid inlet; a second partition is provided within the pipe, one end of the second partition is connected to the side wall of the pipe and the other end of the second partition extends to the mixed liquid inlet so as to form a first channel and a second channel within the pipe; the mixed liquid inlet is simultaneously connected to a side wall of the first channel and a side wall of the second channel; in a direction perpendicular to an axis of the mixed liquid inlet, a first end of the first channel is connected to the first chamber, a second end of the first channel is closed, a first end of the second channel is connected to the second chamber, a second end of the second channel is configured to be connected to a water pump. When the expansion tank of the present application is in use, a mixed liquid of a cooling liquid and a gas simultaneously flows into the first channel and the second channel through the mixed liquid inlet. The mixed liquid flowing into the second channel flows directly into the water pump: the mixed liquid flowing into the first channel enters the first chamber. The gas and cooling liquid are separated within the first chamber under the action of gravity, the separated gas is stored in the expansion tank, the separated cooling liquid enters the second chamber through the first through hole and flows into the water pump through the second channel, thereby reducing the content of gas in the cooling liquid entering the water pump. The expansion tank of the present application has the function of gas-liquid separation, thus there is no need to provide a special liquid-gas separator in the cooling system, thereby facilitating the reduction of the number and total weight of parts in the cooling system, the reduction of the number of pipelines in the cooling system, and the reduction of the costs, and facilitating the lightweight of the vehicle.

BRIEF DESCRIPTION OF DRAWINGS

To describe the technical solutions in embodiments of the present application or the related art more clearly, the following briefly introduces the accompanying drawings needed for describing the embodiments or the related art. Apparently, the accompanying drawings in the following description are some embodiments of the present application, and other accompanying drawings can be obtained according to these accompanying drawings without creative work for persons of ordinary skill in the art.

REFERENCE NUMBERS

Figure 1:
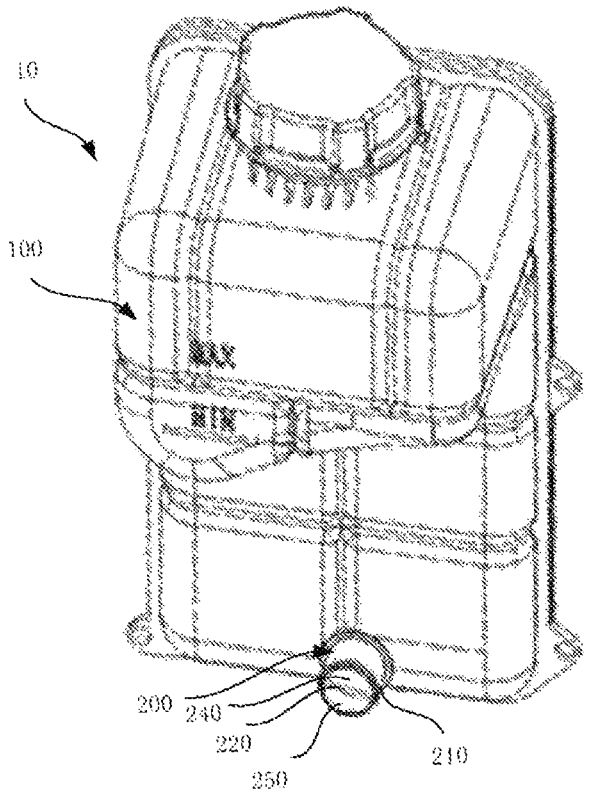
FIG. 1 is a schematic diagram of a structure of an expansion tank provided in an embodiment of the present application.

10—expansion tank;
100—tank body; 101—first sub-tank body; 102—second sub-tank body
110—first chamber; 111—first sub-chamber
120—second chamber; 121—second sub-chamber;
130—first partition; 131—first through hole;
140—third partition; 141—third through hole;
150—fourth partition; 151—fourth through hole;
160—reinforcing rib;
200—pipe; 210—mixed liquid inlet; 220—second partition; 230—first channel; 240—second channel; 250—end cap
20—water pump;
30—part to be cooled;
40—heat exchanger.

DESCRIPTION OF EMBODIMENTS

To make the objectives, technical solutions, and advantages of embodiments of the present application clearer, the following clearly and comprehensively describes the technical solutions in embodiments of the present application with reference to the accompanying drawings in embodiments of the present application. Apparently, the described embodiments are merely a part rather than all embodiments of the present application.

All other embodiments obtained by persons of ordinary skill in the art based on embodiments of the present application without creative effort shall fall within the protection scope of the present application. The following embodiments and the features in the embodiments can be combined with each other in the absence of conflict.

In the solution of the related art, a cooling system that is provided on an electric vehicle includes an expansion tank, a liquid-air separator, an electronic water pump, a part to be cooled (such as a battery pack, a motor, etc.), and a heat exchanger. The liquid-air separator, the electronic water pump, the part to be cooled, and the heat exchanger are connected in turn by pipelines to form a closed-loop circuit. The expansion tank is connected to the liquid-air separator by a pipeline, thereby absorbing the air separated from the liquid-air separator or supplementing a cooling liquid to the liquid-air separator. When in use, the electronic water pump is started to drive the cooling liquid and a gas to flow into the part to be cooled and take heat away; then the cooling liquid enters the heat exchanger for cooling; and the cooling liquid flowing out from the heat exchanger enters the liquid-gas separator for gas-liquid separating, where the gas flows into the expansion tank and the separated cooling liquid flows into the electronic water pump for continuing to perform cooling cycle.

However, when the solution of the related art is used, the number of parts in the cooling system is high and the weight of the parts is heavy, therefore, it is not conducive to lightweight of vehicles.

In view of the above, the present application aims to provide an expansion tank, a cooling system, and a vehicle, the function of gas-liquid separation is integrated in the expansion tank by changing the inlet and outlet structure and the internal structure of the expansion tank, so that the liquid-air separator and some pipelines can be removed from the cooling system, thereby facilitating the reduction of the number and total weight of parts in the cooling system, the reduction of the number of pipelines in the cooling system, and the reduction of the costs, and facilitating the lightweight of the vehicle.

The following will describe in detail the contents of embodiments of the present application in combination with the accompanying drawings, so that persons of ordinary skill in the art can understand the contents of the present application in more detail.

Example 1

Figure 2:
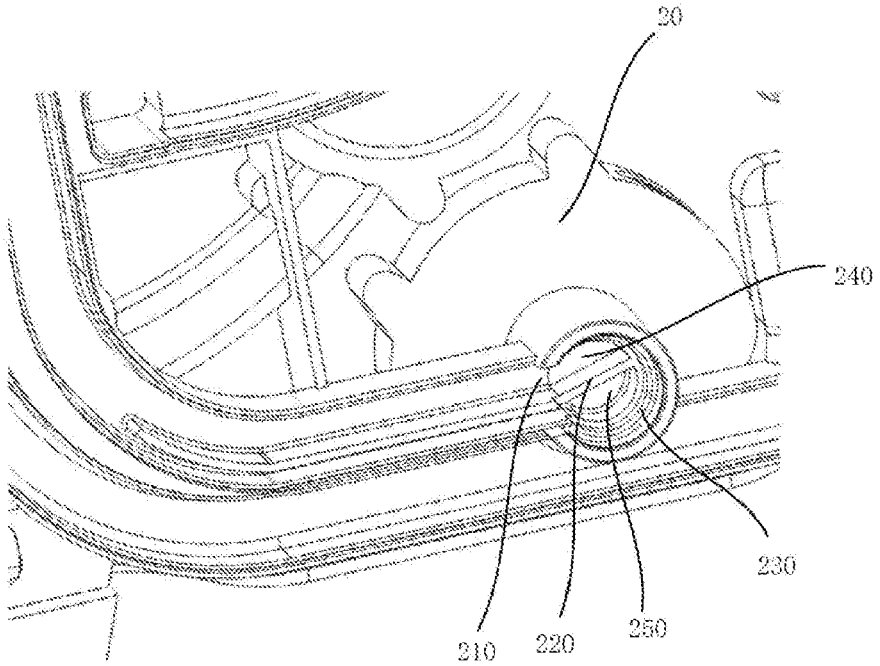
FIG. 2 is a schematic diagram of a connection structure of pipes and other equipment provided in an embodiment of the present application.
Figure 3:
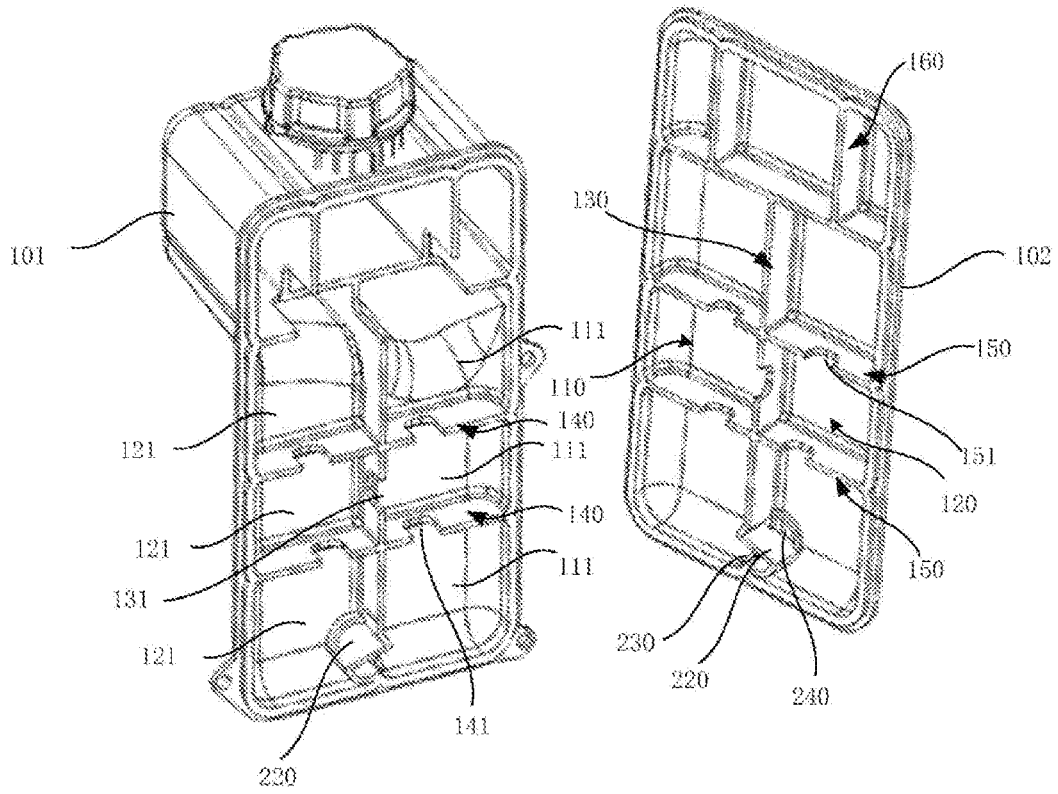
FIG. 3 is an exploded view of an expansion tank provided in an embodiment of the present application.
Figure 4:
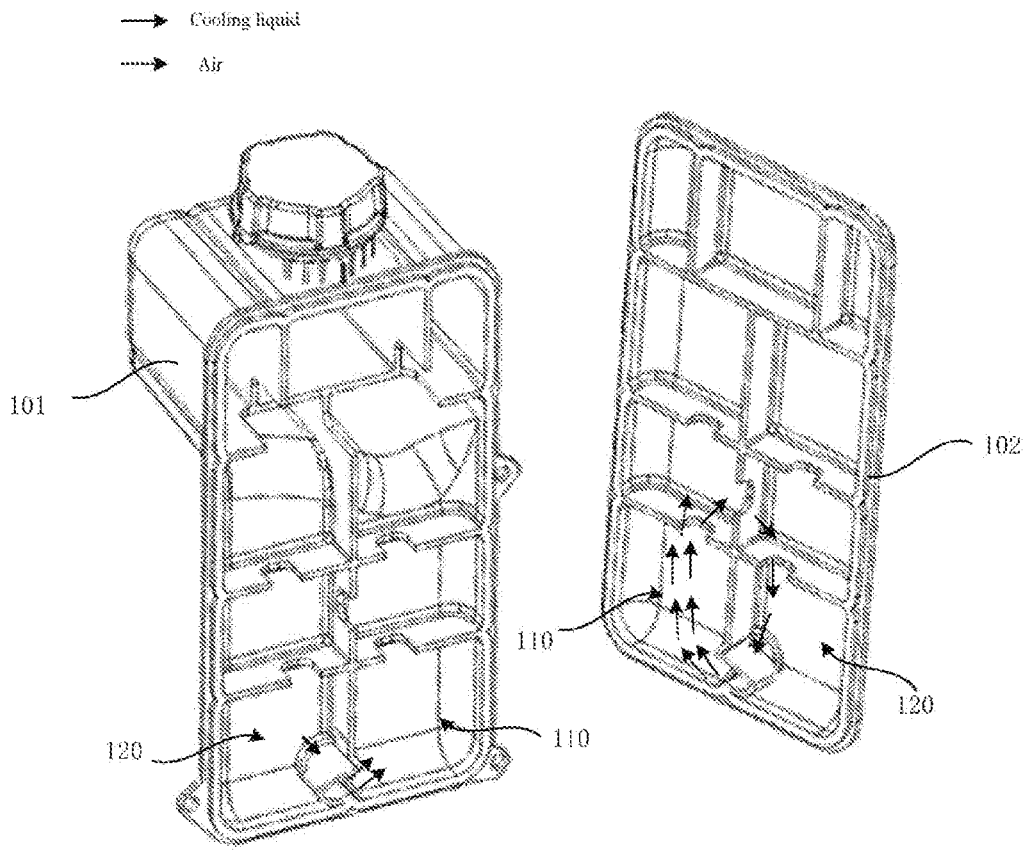
FIG. 4 is a flow direction diagram of a mixed liquid in an expansion tank provided in an embodiment of the present application.

FIG. 1 is a schematic diagram of a structure of an expansion tank provided in an example of the present application: FIG. 2 is a schematic diagram of a connection structure of pipes and other equipment provided in an embodiment of the present application: FIG. 3 is an exploded view of an expansion tank provided in an embodiment of the present application; and FIG. 4 is a flow direction diagram of a mixed liquid in an expansion tank provided in an embodiment of the present application.

Referring to FIGS. 1-4, an embodiment provides an expansion tank 10, including a tank body 100, a first partition 130 is provided within the tank body 100, the first partition 130 divides an interior of the tank body 100 into a first chamber 110 and a second chamber 120, the first partition 130 is provided with a first through hole 131, and the first chamber 110 communicates with the second chamber 120 through first through hole 131.

Specifically, the tank body 100 may be made of a material such as plastic, the tank body 100 is generally cylindrical or prismatic in shape, the tank body 100 may be provided with a protruding portion to make the interior of the tank body 100 have a larger volume.

The first partition 130 can be extended along a direction of gravity to divide the tank body 100 into the first chamber 110 and the second chamber 120, the specific sizes of the first chamber 110 and the second chamber 120 can be determined as needed. The first through hole 131 is provided between the first chamber 110 and the second chamber 120, there is a certain gap between the first through hole 131 and a bottom of the tank body 100 to ensure that a cooling liquid in the first chamber 110 will flow into the second chamber 120 after exceeding a certain height.

The tank body 100 is further provided with a pipe 200 communicating with the interior of the tank body 100, the pipe 200 can also be made of a plastic material, the shape of the cross-section of the pipe 200 may be a circle, a rectangle, or a triangle, preferably a pipe with a circular cross-section is used. A side wall of the pipe 200 is provided with a mixed liquid inlet 210, the mixed liquid inlet 210 is connected to a pipeline of the cooling system to introduce a mixed liquid including a cooling liquid and a gas into the tank body 100. A second partition 220 is provided within the pipe 200, the second partition 220 is provided along an axial direction of the tank body 100, one end of the second partition 220 is connected to the side wall of the pipe 200 and the other end of the second partition 220 extends to the mixed liquid inlet 210 so as to form a first channel 230 and a second channel 240 within the pipe 200. It is understood that the first channel 230 and the second channel 240 are also extend along the axial direction of the pipe 200. The mixed liquid inlet 210 is simultaneously connected to a side wall of the first channel 230 and a side wall of the second channel 240 to make the mixed liquid flow into both the first channel 230 and the second channel 240. In a direction perpendicular to an axis of the mixed liquid inlet 210, a first end of the first channel 230 is connected to the first chamber 110, a second end of the first channel 230 is closed, a first end of the second channel 240 is connected to the second chamber 120, a second end of the second channel 240 is configured to connect a water pump 20. Since the second end of the first channel 230 is closed, the mixed liquid entering the first channel 230 is only able to enter the first chamber 110 within the tank body 100, while the mixed liquid entering the second channel 240 is able to directly flow into the water pump 20.

When the expansion tank 10 of the present embodiment is in use, the mixed liquid of the cooling liquid and gas simultaneously flows into the first channel 230 and the second channel 240 through the mixed liquid inlet 210. The mixed liquid flowing into the second channel 240 flows directly into the water pump 20: the mixed liquid flowing into the first channel 230 enters the first chamber 110. The gas and cooling liquid are separated in the first chamber 110 under the action of gravity, the separated gas is stored in the expansion tank 10, and the separated gas can be discharged through a pressure valve on the tank body 100 when the pressure reaches a certain value: the separated cooling liquid enters the second chamber 120 through the first through hole 131 and flows into the water pump 20 through the second channel 240. By the way as described above, the expansion tank 10 of the present embodiment has a better function of gas-liquid separation, and can reduce the content of gas in the cooling liquid entering the water pump, thereby facilitating the normal operation of the cooling system.

Since the expansion tank 10 of the present embodiment has the function of gas-liquid separation, there is no need to provide a special liquid-gas separator in the cooling system, thereby facilitating the reduction of the number and total weight of parts in the cooling system, the reduction of the number of pipelines in the cooling system, and the reduction of the costs, and facilitating the lightweight of the vehicle.

In a possible implementation, in the present embodiment, the area of the mixed liquid inlet 210 communicating with the first channel 230 is smaller than the area of the mixed liquid inlet 210 communicating with the second channel 240. This makes the volume of the mixed liquid entering the first chamber 110 smaller than the volume of the mixed liquid entering the second chamber 120 per unit time, thereby achieving gas-liquid separation in the mixed liquid while ensuring normal cycle.

In an implementation, the area of the mixed liquid inlet 210 communicating with the first channel 230 may be 0-25% of the area of the mixed liquid inlet 210 communicating with the second channel 240.

In the present embodiment, an end cap 250 is provided on the second end of the first channel 230, and the end cap 250 is fixedly connected to the pipe 200 and the second partition 220. When the shape of the cross-section of the pipe 200 is a circle, the shape of the cross-section of the first channel 230 is generally a semicircle, so that the shape of the end cap 250 may also be a semicircle. The material of end cap 250 is same as that of the tank body 100, and bonding, hot plate welding, etc. may be used for specific connection and fixation.

In an implementation, the pipe 200 in the present embodiment is cylindrical or prismatic in shape, an axis of the pipe 200 is perpendicular with the axis of the mixed liquid inlet 210. When in use, the mixed liquid flows into the first channel 230 and the second channel 240 in a horizontal direction, the mixed liquid flowing into the second channel 240 flows directly into the water pump under the influence of gravity: the mixed liquid flowing into the first channel 230 gradually accumulates to the interior of the first chamber 110 due to the blockage of the end cap 250. Because the gas is lighter, the gas in the mixed liquid is gradually separated to the top of the first chamber 110 under the action of gravity, while the liquid accumulates to the bottom of the first chamber 110. When the liquid accumulates to a certain height, it flows into the second chamber 120 through the first through hole 131 and flows into the water pump under the action of gravity.

In an implementation, the tank body 100 of the present embodiment includes a first sub-tank body 101 and a second sub-tank body 102, the first sub-tank body 101 and the second sub-tank body 102 are welded to form the tank body 100. The first sub-tank body 101 and the second sub-tank body 102 can be divided along a plane perpendicular to the axial direction of the pipe 200, and parts of the first chamber 110, of the second chamber 120, of the first partition 130, and of the second partition 220 are included within each of the first sub-tank body 101 and the second sub-tank body 102. The first sub-tank body 101 and the second sub-tank body 102 form a complete tank body 100 after being combined by hot plate welding. The tank body 100 using split design facilitates setting of the structure within the tank body 100 and is conducive to improving the accuracy of the production.

Further, the first chamber 110 of the present embodiment may include a plurality of first sub-chambers 111, a third partition 140 is provided between two adjacent first sub-chambers 111, the third partition 140 is provided with a third through hole 141. The second chamber 120 may include a plurality of second sub-chambers 121, a fourth partition 150 is provided between two adjacent second sub-chambers 121, the fourth partition 150 is provided with a fourth through hole 151. The third partition 140 and the fourth partition 150 are parallel to each other. In other words, in the present embodiment the first chamber 110 and the second chamber 120 can be divided into a plurality of small chambers that are communicated with each other. Such arrangement, on the one hand, is conducive to enhancing the efficiency of gas-liquid separation inside the tank body 100, and on the other hand, to enhancing the strength of the tank body 100 using the third partition 140 and the fourth partition 150.

In an implementation, in the present embodiment, the first through hole 131 is provided between the first sub-chambers 111 and the second sub-chambers 121 adjacent to the first sub-chambers 111, thereby facilitating gas-liquid separation and increasing the speed of the cooling liquid entering the second chamber 120.

Alternatively, the first through hole 131 is provided between one first sub-chamber 111 of the first sub-chambers 111 and one second sub-chamber 121 of the second sub-chambers 121 adjacent to the one first sub-chamber 111, and preferably may be provided between a first sub-chamber 111 located in a middle position and a second sub-chamber 121 adjacent thereto.

Furthermore, in order to enhance the strength of the tank body 100, a plurality of reinforcing ribs 160 are also provided within the tank body 100, the reinforcing ribs 160 may be provided along a direction parallel to the first partition 130, or may also be provided along a direction parallel to the third partition 140.

As can be seen from the above description, in the expansion tank 10 of the present embodiment, the first chamber 110 and the second chamber 120 that communicate with each other are provided within the tank body 100. The side wall of the pipe 200 communicating with the tank body 100 is provided with the mixed liquid inlet 210, the first channel 230 and the second channel 240 are formed within the pipe 200 by the second partition 220, one end of the first channel 230 is closed and the other end of that is connected to the first chamber 110, the second channel 240 is connected to the second chamber and the water pump. After the mixed liquid flows into the pipe 200, the mixed liquid flowing into the second channel 240 flows directly into the water pump: the mixed liquid flowing into the first channel 230 enters the first chamber 110, the gas and cooling liquid are separated within the first chamber 110 under the action of gravity, the separated gas is stored in the expansion tank 10, and the separated cooling liquid enters the second chamber 120 through the first through hole 131 and flows into the water pump through the second channel 240. Thus, the expansion tank 10 of the present embodiment also has the function of gas-liquid separation, so there is no need to provide a special liquid-gas separator in the cooling system, thereby facilitating the reduction of the number and total weight of parts in the cooling system, the reduction of the number of pipelines in the cooling system and the reduction of the costs, and facilitating the lightweight of the vehicle.

Example 2

Figure 5:
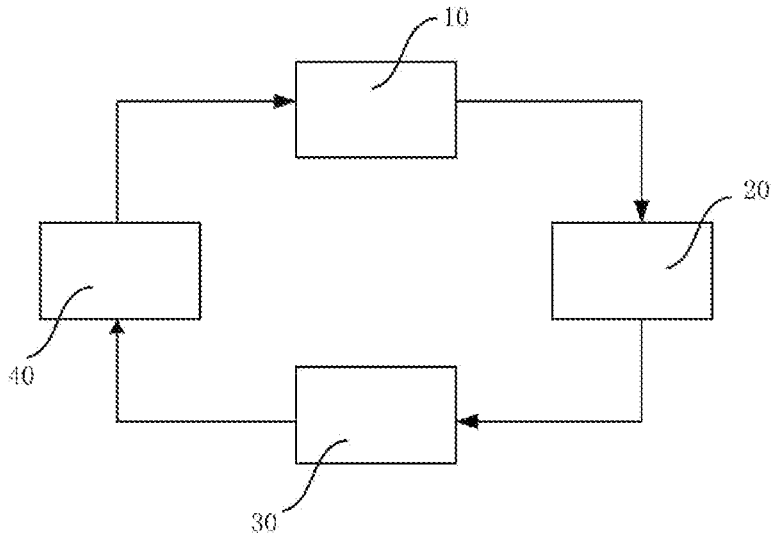
FIG. 5 is a schematic diagram of a structure of a cooling system provided in an embodiment of the present application.

FIG. 5 is a schematic diagram of a structure of a cooling system provided in an embodiment of the present application.

Referring to FIG. 5, the present embodiment provides a cooling system including a water pump 20, a part to be cooled 30, a heat exchanger 40, and an expansion tank 10 as any one of described above, and the water pump 20, the part to be cooled 30, the heat exchanger 40, and the expansion tank 10 are connected in turn by pipelines, where the heat exchanger 40 is connected to the mixed liquid inlet of the expansion tank 10, the second channel of the expansion tank 10 is connected to the water pump 20.

Specifically, the part to be cooled 30 in the present embodiment can be an engine, motor, or battery pack, and the like. The water pump 20 is used to provide circulating power for the whole system, the mixed liquid of the cooling liquid and gas can circularly flow along the pipeline in the system under the action of the water pump 20 to reduce the temperature of the part to be cooled 30. Since the expansion tank 10 of Example 1 is provided, the mixed liquid can realize gas-liquid separation in the expansion tank 10, thus reducing the amount of gas that circulates within the cooling system, and eliminating the need of installing a special liquid-gas separator in the cooling system, thereby facilitating the reduction of the number and total weight of parts in the cooling system, the reduction of the number of pipelines in the cooling system, and the reduction of the costs, and facilitating the lightweight of the vehicle.

Example 3

The present embodiment provides a vehicle including a cooling system in Example 2 as described above.

Specifically, the cooling system in the present embodiment can be located in an engine compartment of the vehicle or in a space between a chassis and a body of the vehicle. For the vehicle of the present embodiment, since the cooling system in Example 2 as described above is used, no special liquid-gas separator is needed to provide in the cooling system, thereby facilitating the reduction of the number and total weight of parts in the cooling system, the reduction of the number of pipelines in the cooling system, and the reduction of the costs, and facilitating the lightweight of the vehicle.

In the description of the present application, it is to be understood that the terms "center", "longitudinal", "transverse", "length", "width", "thickness", "up", "down", "front", "back", "left", "right", "vertical", "horizontal", "top", "bottom", "inside", "outside", "clockwise", "counterclockwise", "axial", "radial", "circumferential", etc. indicate the orientation or position relationship based on the orientation or position relationship shown in the accompanying drawings, only to facilitate the description of the present application and simplify the description, and not to indicate or imply that the device or component referred to must have a specific orientation, be constructed and operated in a specific orientation, and therefore cannot be interpreted as a limitation to the present application.

In the present application, unless otherwise expressly specified and limited, the terms "mounted", "linked", "connected", "fixed", etc. shall be understood in a broad sense, for example, the connection may be fixed connection, detachable connection, integrated connection, direct connection, indirect connection by an intermediate medium, interconnection between the interiors of two components, or an interaction relationship between two components. For persons of ordinary skill in the art, the specific meanings of the aforesaid terms in the present application can be understood based on the specific situations.

It should be noted that in the description of the present application, the terms "first" and "second" are only used to facilitate the description of different components and are not to be understood as indicating or implying a sequential relationship, relative importance, or implicitly specifying the number of the indicated technical features. Thus, the features defined with "first" and "second" may explicitly or implicitly include at least one such feature.

Each embodiment or implementation in the present application is described in a progressive manner, each embodiment emphatically explain the difference from the other embodiment, and the same and similar part between various embodiments can be referred to between each other.

In the description of the present application, the description of the reference terms "an embodiment", "some embodiments", "schematic embodiment", "example", "specific example", or "some examples" means that specific features, structures, materials, or characteristics described in conjunction with embodiments or examples are included in at least one embodiment or example of the present application. In the present application, the schematic description of the aforesaid terms does not refer to the same embodiment or example. Moreover, the specific features, structures, materials, or characteristics described may be combined in a suitable manner in any one or more embodiments or examples.

Finally, it should be noted that the foregoing embodiments are merely intended for describing the technical solutions of the present application other than limiting the present application. Although the present application is described in detail with reference to the foregoing embodiments, persons of ordinary skill in the art should understand that they may still make modifications to the technical solutions described in the foregoing embodiments or make equivalent substitutions to some or all technical features thereof, and these modifications or substitutions do not make the essence of corresponding technical solutions depart from the scope of the technical solutions of embodiments of the present application.

What is claimed is:

1. An expansion tank comprising a tank body; a first partition within the tank body, where the first partition is extended in a longitudinal direction of the expansion tank to divide an interior of the tank body into a first chamber and a second chamber, the first partition is provided with a first through hole, and the first chamber communicates with the second chamber through the first through hole;

wherein the first chamber comprises a plurality of first sub-chambers, a third partition is provided between two adjacent first sub-chambers, the third partition is provided with a third through hole; and the second chamber comprises a plurality of second sub-chambers, a fourth partition is provided between two adjacent second sub-chambers, and the fourth partition is provided with a fourth through hole; and the third partition and the fourth partition are parallel to each other and perpendicular to and connected to the first partition;

the tank body is provided with a pipe communicating with an interior of the tank body, and a side wall of the pipe is provided with a mixed liquid inlet; a second partition is provided within the pipe, one end of the second partition is connected to the side wall of the pipe and the other end of the second partition extends to the mixed liquid inlet so as to form a first channel and a second channel within the pipe; the mixed liquid inlet is connected to a side wall of the first channel and a side wall of the second channel; and in a direction perpendicular to an axis of the mixed liquid inlet, a first end of the first channel is connected to the first chamber, a second end of the first channel is closed, a first end of the second channel is connected to the second chamber, and a second end of the second channel is configured to be connected to a water pump.

2. The expansion tank according to claim 1, wherein an area of the mixed liquid inlet communicating with the first channel is smaller than an area of the mixed liquid inlet communicating with the second channel.

3. The expansion tank according to claim 2, wherein the area of the mixed liquid inlet communicating with the first channel is 0-25% of the area of the mixed liquid inlet communicating with the second channel.

4. The expansion tank according to claim 1, wherein an end cap is provided on the second end of the first channel, and the end cap is fixedly connected to the pipe and the second partition.

5. The expansion tank according to claim 1, wherein the pipe is cylindrical or prismatic in shape, an axis of the pipe is perpendicular to an axis of the mixed liquid inlet.

6. The expansion tank according to claim 1, wherein the tank body includes a first sub-tank body and a second sub-tank body, the first sub-tank body and the second sub-tank body are welded to form the tank body.

7. The expansion tank according to claim 1, wherein the first through hole is provided between the first sub-chambers and the second sub-chambers adjacent to the first sub-chambers; or the first through hole is provided between one first sub-chamber of the first sub-chambers and one second sub-chamber of the second sub-chambers adjacent to the one first sub-chamber.

8. The expansion tank according to claim 1, wherein a plurality of reinforcing ribs are further provided within the tank body.

9. The expansion tank according to claim 8, wherein the reinforcing ribs are plate-shaped, and are provided along a direction parallel to the first partition, or are provided along a direction parallel to the third partition and the fourth partition.

10. A cooling system comprising a water pump, a part to be cooled, a heat exchanger, and the expansion tank according to claim 1; and the water pump, the part to be cooled, the heat exchanger, and the expansion tank are connected in turn by pipelines, wherein the heat exchanger is connected to the mixed liquid inlet of the expansion tank, the second channel of the expansion tank is connected to the water pump.

11. A vehicle comprising the cooling system according to claim 10.

12. The expansion tank according to claim 1, wherein the first chamber comprises two third partitions, the second chamber comprises two fourth partitions, and the first through hole is provided between the two third partitions and between the two fourth partitions.

* * * * *